United States Patent [19]

Clements

[11] 4,086,978

[45] May 2, 1978

[54] BUILT-IN SCAFFOLD SUPPORT

[76] Inventor: Lawrence H. Clements, P.O. Box 134, Humboldt, Kans. 66748

[21] Appl. No.: 735,108

[22] Filed: Oct. 22, 1976

[51] Int. Cl.[2] ..... E04G 3/08; E04G 9/00

[52] U.S. Cl. ..... 182/82; 248/235; 52/36; 52/376

[58] Field of Search ..... 182/82; 52/36, 376; 248/235

[56] References Cited

U.S. PATENT DOCUMENTS

| | | | |
|---|---|---|---|
| 418,788 | 1/1890 | Graves | 52/36 |
| 474,406 | 5/1892 | Ramsey | 182/82 |
| 1,482,434 | 2/1924 | Hotchkiss | 182/82 |
| 3,394,507 | 7/1968 | Doke | 52/36 |
| 3,468,507 | 9/1969 | Gerdman | 52/36 |
| 3,484,364 | 11/1974 | Costruba | 52/36 |

FOREIGN PATENT DOCUMENTS

| | | | |
|---|---|---|---|
| 804,716 | 4/1951 | Germany | 52/376 |

*Primary Examiner*—Reinaldo P. Machado
*Attorney, Agent, or Firm*—Edward L. Brown, Jr.

[57] ABSTRACT

A device to facilitate use of scaffolding during construction of wood frame buildings by using a light-weight metal channel attached to and encasing occasional studs. Brackets hook into the channels at various desired heights, supporting planks which provide the working surface. At outside corners, one bracket hooks into the side of another at right angles to provide a scaffold in both directions from the corner using but one vertical channel. Channels are left in place and covered up as the siding is applied.

7 Claims, 7 Drawing Figures

BUILT-IN SCAFFOLD SUPPORT

BACKGROUND OF THE INVENTION

This invention pertains to the field of scaffolding and more particularly to left-in-place scaffolding used during the erection of wood frame buildings and the application of their exterior coverings.

The following U.S. patents describe left-in-place or built-in scaffold supports which differ however from this invention:

- U.S. Pat. No. 1,141,554, Klumpp, describes a scaffold support consisting of a hollow dowel with inwardly extending retaining claws. It is adapted to be laid up as an exposed permanent unit in the face of brick walls. It is not usefully adaptable to a wood frame wall.
- U.S. Pat. No. 1,719,261, De Las Heras, describes a method of building a wall using masonry units having built-in transverse openings for scaffold support elements which can be removed later. This method is not adaptable to a wood framed structure.
- U.S. Pat. No. 1,695,213, Skinner, describes a metal bracket to grip and support the inner end of a scaffold bearer. It is eventually covered by the exterior facing and is adapted to a wood framed and sheathed wall. It is not, however, adaptable to independently supporting a scaffold, as the present invention is, without an outer vertical member.

Compared to the present invention, one of the U.S. patents cited above requires more labor and material to install and the other two are not adaptable to wood frame structures.

SUMMARY OF THE INVENTION

This scaffold support for a wood frame structure is a formed metal channel, having a web and a pair of flanges, sized to fit around a vertical member of a wood frame, encasing the face and at least a portion of the sides of the member. Channels are spaced a convenient distance apart. A pair of studs, side by side, form the vertical member. The flanges of the channel are fastened to the member by a convenient means such as nailing. Protruding from the web of the channel is a full length rib having a plurality of vertical slots in its face at regular intervals. The web on each side of the rib serves as a support for a sheathing that is fastened to the studs by nailing the sheathing through the web to the stud.

A bracket having a hook-shaped projection on its inner end hooks to the channel rib through one of the slots into a recess between the rib and the studs. At least one plank is placed spanning at least two brackets to form a platform of the scaffold.

There are a pair of auxiliary ribs enclosing recesses on either side of the bracket adjacent to its inner end into which another bracket can be hooked at right angles to the first bracket to support an adjoining platform at an outside corner of the structure.

An object of the invention is to provide a permanently mounted scaffold bracket in wood frame construction.

It is also an object of the invention to reduce the cost of a wood frame building by using a low cost built-in channel in place of the higher cost labor and material needed to build and dismantle a conventional wood or metal scaffold.

The brackets are reusable and being relatively small, they do not cost as much nor occupy as much storage space as conventional metal scaffold.

Another object of the invention is to provide a scaffolding means in conventional wood frame construction which also adds strength to the wood frame structure.

DESCRIPTION OF THE PREFERRED EMBODIMENT

Figure 1:
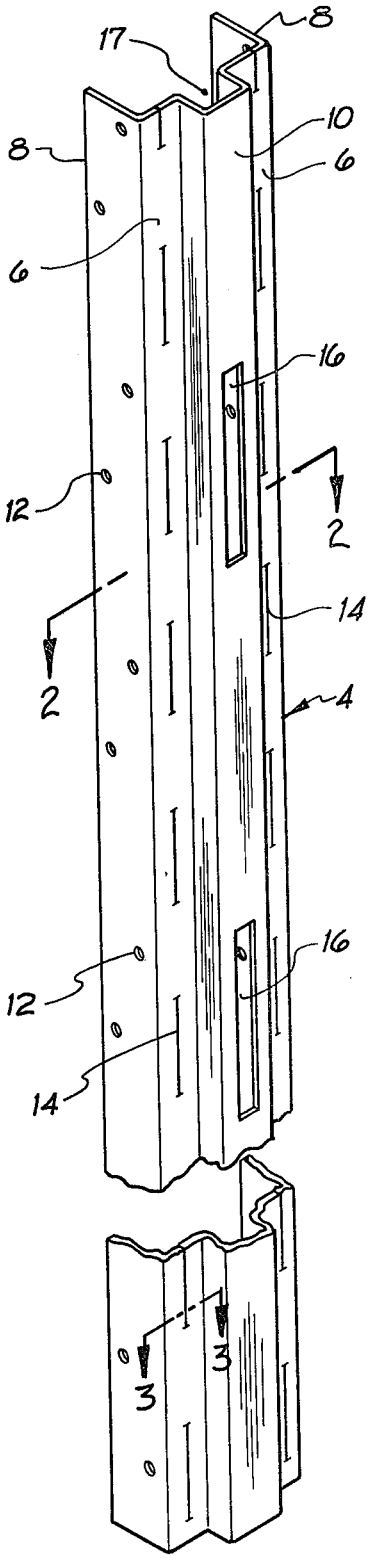
FIG. 1 is an isometric view of a channel with a portion broken out.
Figure 2:
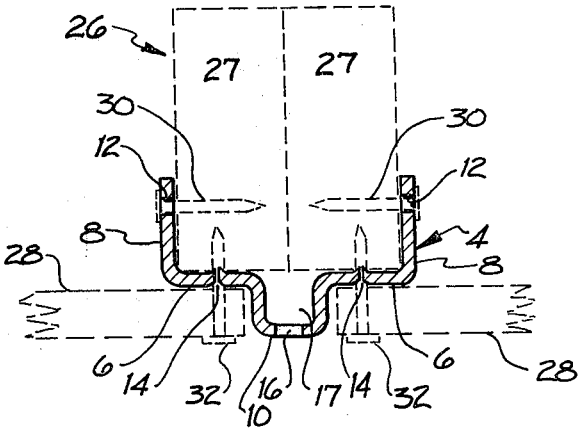
FIG. 2 is a cross sectional view along line 2—2 of FIG. 1 showing the channel with a vertical wood member and a sheathing added.
Figure 7:
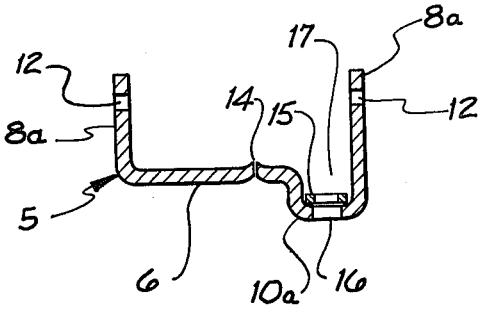
FIG. 7 is a cross sectional view, in the same aspect as FIG. 2, showing a channel modified for use at an outside corner of the structure.

Referring to FIGS. 1 and 2, a channel 4 is shown with a pair of flanges 8, a web 6 and a rib 10 protruding from the web 6. The channel 4 is formed from metal sheet 0.02 to 0.0625 inches (0.5 to 1.6 mm) thick so that it will fit over a vertical member of the wood frame 26 consisting of a pair of studs 27, about 3 inches (76 mm) thick overall. The flanges 8 extend along the sides of the member 26 far enough to permit fastening the channel 4 to the member 26. A nail 30 is shown as one method of fastening and other means for fastening will be evident to one skilled in wood framing. The rib 10 forms a recess 17 between itself and the member 26. A plurality of slots 16 in the face of the rib 10 provide locations where scaffold platforms may be supported. The web 6 provides a support and fastening area for a sheathing 28. The projection of the rib 10 from the web 6 does not ordinarily exceed 0.75 inches (19 mm) in order that the rib 10 does not protrude beyond the flush surface of regular thickness of the sheathing 28. A nail 32 fastens the sheathing to the member 26 by passing through the web 6 of the channel 4. When the channel 4 is formed of metal near the maximum thickness aforesaid, it is convenient to provide a plurality of openings 12 in flange 8 and a plurality of slits 14 in the web 6 to facilitate passage of fasteners, such as the nails 30 and 32, through the channel 4. When the channel 4 is formed of the minimum thickness aforesaid, the openings 12 and the slits 14 are unnecessary but a reinforcement 15, as can be seen in FIG. 7, is added around the slot 16.

Figure 3:
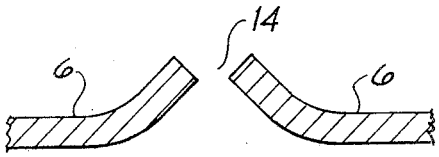
FIG. 3 is an enlarged partial cross sectional view along the line 3—3 of FIG. 1 showing a slit in the web of the channel.

FIG. 3 shows an enlarged detail, in section, of the slit 14 in the web 6.

Figure 4:
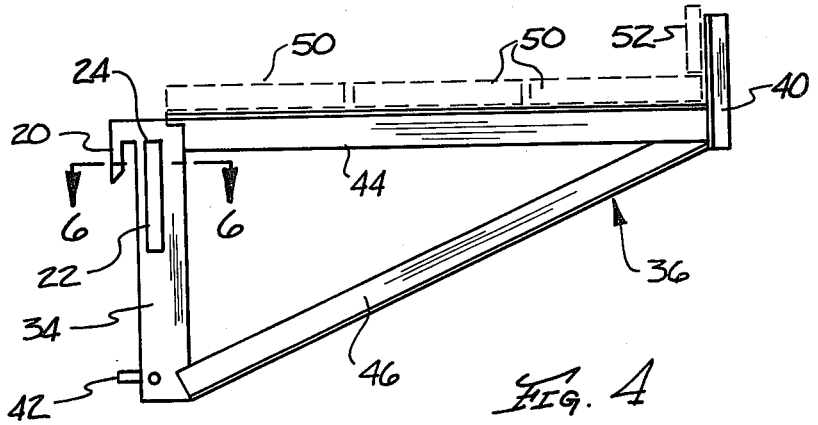
FIG. 4 is a side elevational view of one embodiment of a bracket.
Figure 6:
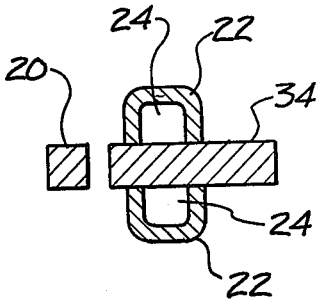
FIG. 6 is an enlarged partial cross sectional view along the line 6—6 in FIGS. 4 and 5 showing a part of the bracket.

A bracket 36 is shown in FIG. 4. It has an upper member 44, a diagonal member 46, a toe board support member 40 and a vertical inner end member 34. Member 34 has a hook-shaped projection 20 near its top, a knob 42 projecting near its bottom and a channel-shaped auxiliary rib 22 on each side. The auxiliary rib 22 forms an auxiliary recess 24 which can best be seen in FIG. 6 which also shows the member 34 and the projection 20. The member 40 supports a toe board 52. The upper member 44 provides support for at least one plank 50 which forms the working platform of the scaffold. The knob 42 and the projection 20 are sized and spaced to fit into the slots 16 of channel 4.

Figure 5:
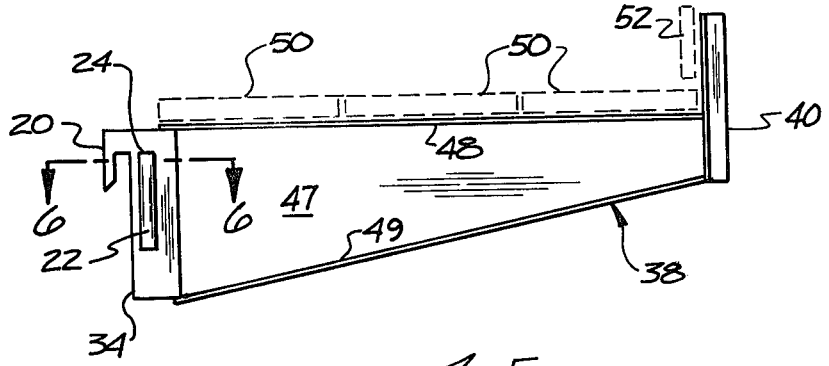
FIG. 5 is a side elevational view of another embodiment of the bracket.

Another embodiment of bracket is shown in FIG. 5. A bracket 38 has a web 47, an upper flange 48, a lower flange 49, a toe board support member 40, and a vertical inner end member 34. Member 34 has a hook-shaped projection 20 near its top and a channel-shaped auxiliary rib 22 on each side like the previous bracket. The auxiliary rib 22 and its auxiliary recess 24 can best be seen in FIG. 6 which also shows the member 34 and the projection 20. The member 40 supports a toe board 52. The upper flange 48 provides support for at least one plank 50 which forms the working platform of the scaffold. The projection 20 is sized to fit into the slot 16 of channel 4.

Referring now to FIG. 7, this shows a corner channel 5 for use at outside corners of a building structure. The rib 10*a* is located adjacent to one of the flanges 8a so that the sheathing 28, not shown in FIG. 7, can extend closer to the corner of the structure. This corner channel 5 is reversible, top for bottom, to provide for right-hand and left-hand corners. The reinforcement 15 is shown in FIG. 7 as aforementioned. The reinforcement 15 can be used on the regular channel 4 of FIG. 2 as well as on the corner channel 5.

The channels 5 and 4 are made in a convenient length of 6 to 8 feet (1.8 to 2.5 m) and the brackets 36 and 38 accommodate a platform 30 to 36 inches (0.75 to 0.91 m) or greater in width. The hook-shaped projection 20 is about ½ inch (13 mm) square in section and the knob 42 is about ½ inch (13 mm) in diameter.

MODE OF OPERATION

The channel 4 is placed over a double stud 27 vertical member 26, as seen in FIG. 2, every 8 feet (2.5 m) along the wood frame wall, substituting the corner channel 5 at outside corners of the structure. Channels 4 and 5 are fastened through the flanges 8 to the vertical member 26. The bracket 36 is hooked into the slot 16 which is at the desired height. After a second bracket 36 is in place in a slot 16 in another channel approximately 8 feet (2.5 m) distant, a plank 50 is placed on the brackets to provide a working platform. The bracket 38 can be substituted for the bracket 36. With the brackets in place, the sheathing 28 is applied along with the roofing, eaves, etc. The brackets 36 are removed as the siding is completed above a given bracket 36. The channels 4 remain in the wall and are normally not seen once the finish siding is in place. However, holes can be cut in the finish siding so that the brackets 36 and scaffold can be used again at a later date.

Having described the invention with sufficient clarity to enable those familiar with the art to construct and use it, I claim:

1. A scaffold support for use during the construction of a sheathed wood frame structure including vertical stud members which remains as a part of the structure, comprising:

a formed metal channel, having a pair of flanges, of a size to fit around a part of two sides of said vertical stud members of the wood frame;

means in the pair of flanges for fastening the formed metal channel to said vertical members of the structure;

a rib protruding outwardly from the channel and having a plurality of vertical slots therealong;

a recess, enclosed by the rib and said vertical members of the wood frame, accessible through the slot;

a web on each side of the rib in abutting relation with said vertical stud members extending to the flanges and providing a support for the sheathing;

means for fastening the sheathing through the web to said vertical members; and means for supporting a removable scaffold platform from the slot in the rib.

2. A scaffold support as recited in claim 1, in which the fastening means for the channel and for the sheathing is nailing.

3. A scaffold support a recited in claim 1, in which the flanges have openings and the web has slits to facilitate fastening.

4. A scaffold support as recited in claim 1, in which the means for supporting the scaffold platform comprises:

a bracket which projects out from the channel; and a hook-shaped projection on an end of the bracket which projection is of a size that will fit into one of the recesses in the rib of the channel.

5. A scaffold support as recited in claim 4, further comprising:

an auxiliary rib containing a recess and protruding outwardly from the side of the bracket, adjacent to the end of the bracket which fits into the recess in the rib of the channel, so that a second bracket can be placed at a right angle in order to support scaffolding at an exterior corner of the structure.

6. A scaffold support as recited in claim 1 further comprising a reinforcement strip fixed inside the rib, having a plurality of vertical slots alike in size and spacing to those in the rib, and aligned with them.

7. A scaffold support for use during the construction of a sheathed wood frame structure and which remains as a part of the structure, comprising:

a formed metal channel, having a pair of flanges, of a size to fit around a part of two sides of a vertical member of the wood frame;

means for fastening the formed metal channel to the vertical member of the structure;

a rib, adjacent to one flange, protruding outwardly from the channel and having a plurality of vertical slots;

a recess, enclosed by the rib and the vertical member of the wood frame, accessible through the slot;

a web extending from the rib in abutting relation with said vertical member to the flange on the opposite side and providing a support for the sheathing;

means for fastening the sheathing, through the web, to the vertical member; and means for supporting a removable scaffold platform from the slot in the web.

* * * * *